US011180978B2

(12) United States Patent
Bolt

(10) Patent No.: US 11,180,978 B2
(45) Date of Patent: Nov. 23, 2021

(54) RETRIEVABLE PUMP SYSTEMS FOR WELLS AND METHODS OF USE

(71) Applicant: David Joseph Bolt, Duncansville, PA (US)

(72) Inventor: David Joseph Bolt, Duncansville, PA (US)

(73) Assignee: Cormorant Engineering, LLC, New Waverly, TX (US)

( * ) Notice: Subject to any disclaimer, the term of this patent is extended or adjusted under 35 U.S.C. 154(b) by 675 days.

(21) Appl. No.: 14/999,852

(22) PCT Filed: Jan. 15, 2015

(86) PCT No.: PCT/US2015/000006

§ 371 (c)(1),
(2) Date: Jul. 11, 2016

(87) PCT Pub. No.: WO2015/119724

PCT Pub. Date: Aug. 13, 2015

(65) Prior Publication Data

US 2018/0187532 A1 Jul. 5, 2018

Related U.S. Application Data

(60) Provisional application No. 61/965,783, filed on Feb. 7, 2014.

(51) Int. Cl.
*E21B 43/12* (2006.01)
*E21B 23/02* (2006.01)

(52) U.S. Cl.
CPC ..... *E21B 43/129* (2013.01); *E21B 23/02* (2013.01)

(58) Field of Classification Search
CPC ..... E21B 43/12; E21B 43/121; E21B 43/129; E21B 43/13
See application file for complete search history.

(56) References Cited

U.S. PATENT DOCUMENTS

| | | | | |
|---|---|---|---|---|
| 2,081,220 | A | 5/1937 | Coberly | |
| 2,119,736 | A | 6/1938 | Coberly | |
| 2,291,880 | A | 8/1942 | Coberly | |
| 2,311,157 | A | 2/1943 | Coberly | |
| 2,935,953 | A | 5/1960 | Coberly | |
| 2,949,857 | A | 8/1960 | Coberly | |
| 3,034,442 | A | 5/1962 | Coberly et al. | |
| 3,082,749 | A | 3/1963 | Coberly | |
| 4,293,287 | A | 10/1981 | Carrens | |
| 4,504,195 | A | 3/1985 | Binks et al. | |
| 4,565,496 | A * | 1/1986 | Soderberg | F04B 47/08 417/390 |
| 4,658,893 | A | 4/1987 | Black | |
| 4,753,577 | A | 6/1988 | Black et al. | |
| 4,815,949 | A * | 3/1989 | Rabson | F04B 47/06 310/14 |

(Continued)

*Primary Examiner* — Kristyn A Hall
(74) *Attorney, Agent, or Firm* — Guy McClung; E. Randall Smith

(57) ABSTRACT

A wellbore pumping system for pumping fluid, the system with a retrievable reciprocating pump selectively disposable in inner tubing (which may be e.g. production tubing or coiled tubing) movable to and from a landing structure of a bottom hole assembly ("BHA"), the BHA connected to another tubular which is an outer tubular, such as production tubing or casing, which encompasses the inner tubing.

13 Claims, 7 Drawing Sheets

(56) References Cited

U.S. PATENT DOCUMENTS

| | | | | |
|---|---|---|---|---|
| 5,083,609 | A | 1/1992 | Coleman | |
| 5,472,054 | A | 12/1995 | Hinds | |
| 5,651,664 | A | 7/1997 | Hinds et al. | |
| 5,667,364 | A | 9/1997 | O'Mara et al. | |
| 6,089,832 | A | 7/2000 | Patterson | |
| 6,155,792 | A | 12/2000 | Hartley et al. | |
| 7,419,007 | B2 | 9/2008 | Belcher et al. | |
| 7,909,089 | B2 | 3/2011 | Jackson | |
| 8,302,695 | B2 | 11/2012 | Simpson et al. | |
| 8,303,272 | B2 | 11/2012 | Pugh et al. | |
| 2012/0076668 | A1* | 3/2012 | Bolt | F04B 47/12 417/53 |

* cited by examiner

RETRIEVABLE PUMP SYSTEMS FOR WELLS AND METHODS OF USE

RELATED APPLICATION

The present invention and this application claim the benefits of priority under the Patent Laws from U.S. Application Ser. No. 61/965,783 filed Feb. 7, 2014

BACKGROUND OF THE INVENTION

Field Of The Invention

The present invention is directed to retrievable downhole pumps for pumping production fluids from a well, e.g. fluids such as liquids, hydrocarbons, oil, water and gas; such pumps which are reciprocating pumps; such pumps which are maintained in place by the pressure of a power fluid and which are retrievable by reversing the flow of power fluid; and methods for using such pumps.

Description of Known Pumps

There are a variety of known pumps and pumps for pumping production fluids from a well; for example, and not limited to, those disclosed in U.S. Pat. Nos. 2,081,220; 2,119,736; 2,291,880; 2,311,157; 2,935,953; 2,949,857; 3,034,442; 3,082,749; 4,504,195; 4,658,893; 4,753,577; 5,083,609; 5,651,664; 5,667,364; and 7,909,089—all said patents incorporated fully herein for all purposes.

SUMMARY OF THE PRESENT INVENTION

The present invention, in certain aspects, discloses a wellbore pumping system with a retrievable pump selectively disposable in inner tubing movable to and from a landing structure of a bottom hole assembly, the bottom hole assembly connected to another tubular such as production tubing or casing which encompasses the inner tubing. In certain aspects, the inner tubing is coiled tubing. Production fluids from the wellbore are pumped by the retrievable pump into a production fluid annulus between the inner tubing and the production tubing to the surface.

In one aspect, fluid is pumped from the surface down the production fluid annulus, freeing the retrievable pump, and then the freed retrievable pump is pumped to the surface within the inner tubing. The retrievable pump may be deployed from and received back within a receiver on a wellhead at the surface. In certain aspects, any suitable pump which can supply a sufficient continuous flow of high pressure fluid can be used.

In certain aspects, the retrievable pump includes an integral valve for controlling the pump and for reciprocating a pump plunger or power piston within a power section of the pump to provide reciprocal pumping action. The pumping unit may have seal apparatus for sealing the interface between the pump and the bottom hole assembly. The pump includes a power section and a production fluid section.

The bottom hole assembly, in certain aspects, sits in a seating nipple at the bottom of the production tubing (or casing). The bottom hole assembly, which houses the pumping unit and which seals the production fluid annulus and the wellbore, in certain aspects, has a one-way valve which isolates higher pressure fluids in the inner tubing and in the production fluid annulus from lower pressure fluids in the wellbore. The bottom hole assembly has one (or a plurality of) fluid communication ports which provide for the flow of production fluid pumped by the pump to flow into the production fluid annulus.

During a pumping operation, in certain aspects of certain embodiments, the power section receives power fluid from the inner tubing; and return fluid from the power section is combined with pumped production fluid. The one-way valve controls the flow of production fluids from the wellbore to the pump; and the production fluid section allows fluid to enter the one-way valve and then this fluid is forced out of the production section into the produced fluid annulus where the pressure is higher than within the wellbore below the bottom hole assembly.

In certain aspects, no latch or mechanical holding mechanism is needed to maintain the pump in position within the inner tubing. This is done simply by the pressure of fluid above the pump. In certain aspects, the pump is retrieved by reversing the differential pressure across the pump. Power fluid is directed down the produced fluid annulus and the pump is lifted to the surface.

In certain aspects, the pump is pumped up the well and is received within a receiver apparatus on top of the wellhead. The receiver apparatus is in communication with the wellhead and has an isolation valve that is closed once the pump is situated within a catcher/lubricator section of the receiver apparatus. The pump is removable from (and insertable into) the catcher/lubricator section.

Accordingly, the present invention includes features and advantages which are believed to enable it to advance wellbore retrievable pump technology. Characteristics and advantages of the present invention described above and additional features and benefits will be readily apparent to those skilled in the art, who have the benefits of the present invention's teachings, upon consideration of the following description of certain embodiments and referring to the accompanying drawings.

Certain embodiments of this invention are not limited to any particular individual feature disclosed here, but include combinations of them distinguished from the prior art in their structures, functions, and/or results achieved.

It is, therefore, an object of at least certain embodiments of the present invention to provide new, useful, unique, efficient, nonobvious retrievable wellbore production fluid pumps; such pumps that are retrievable and/or are reciprocating pumps; and new, useful, unique, efficient and nonobvious methods of their use.

The present invention recognizes and addresses the problems and needs in this area and provides a solution to those problems and a satisfactory meeting of those needs in its various possible embodiments and equivalents thereof. To one of skill in this art who has the benefits of this invention's realizations, teachings, disclosures, and suggestions, various purposes and advantages will be appreciated from the following description of certain embodiments, given for the purpose of disclosure, when taken in conjunction with the accompanying drawings. The detail in these descriptions is not intended to thwart this patent's object to claim this invention no matter how others may later attempt to disguise it by variations in form, changes, or additions of further improvements.

The Abstract that is part hereof is to enable the U.S. Patent and Trademark Office and the public generally, and scientists, engineers, researchers, and practitioners in the art who are not familiar with patent terms or legal terms of phraseology to determine quickly, from a cursory inspection or review, the nature and general area of the disclosure of this invention. The Abstract is neither intended to define the invention, which is done by the claims, nor is it intended to be limiting of the scope of the invention in any way.

It will be understood that the various embodiments of the present invention may include one, some, or all of the disclosed, described, and/or enumerated improvements and/or technical advantages and/or elements in claims, in any possible combination, to this invention.

BRIEF DESCRIPTION OF THE SEVERAL VIEWS OF THE DRAWINGS

These drawings illustrate various embodiments and are not to be used to improperly limit the scope of the invention which may have other equally effective or legally equivalent embodiments.

The figures are not necessarily to scale.

DETAILED DESCRIPTION OF SOME EMBODIMENTS OF THE INVENTION

Figure 1:
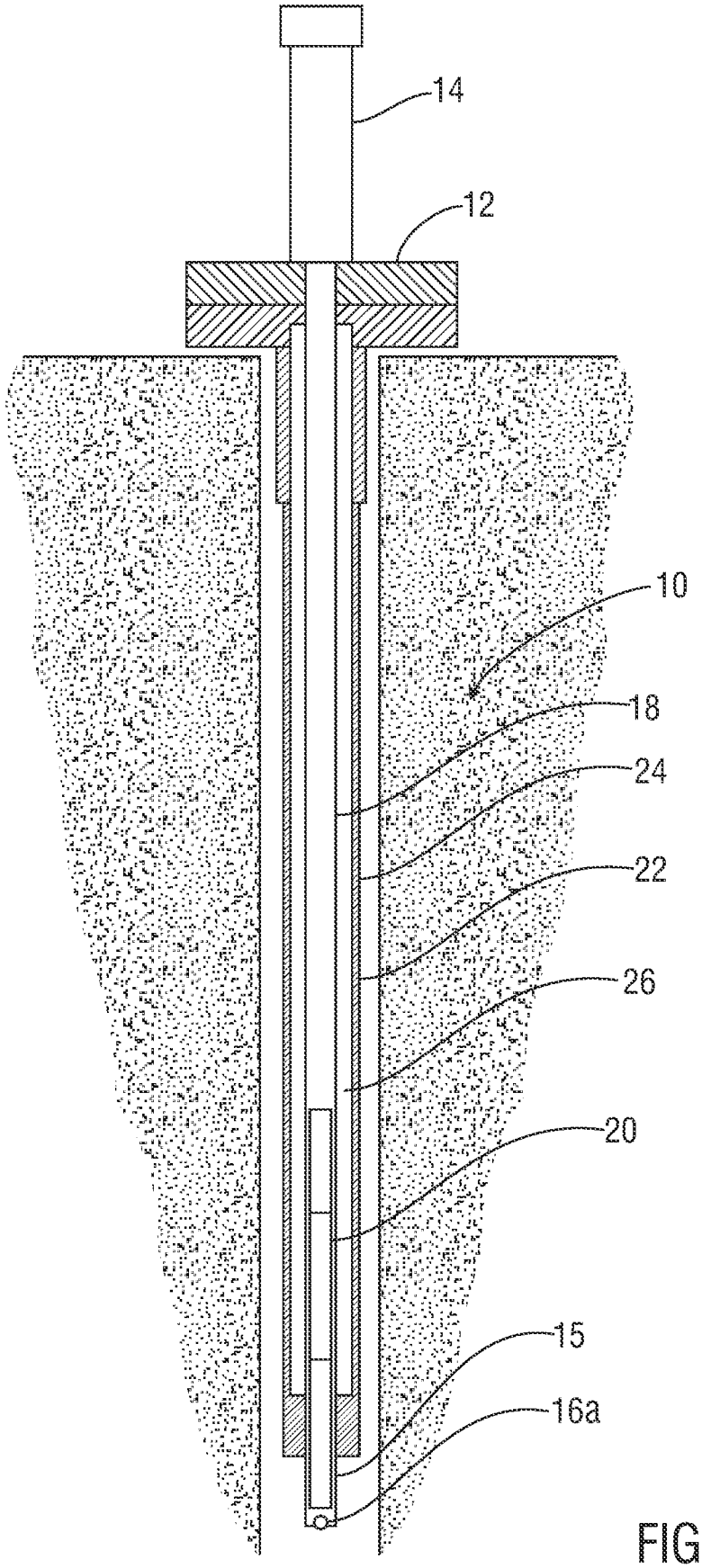
FIG. 1 is a side schematic view of a system according to the present invention with a pump according to the present invention.

FIG. 1 shows a system 10 according to the present invention which has a wellhead 12 at the earth's surface on top of which is a pump receiver 14 for selectively housing a pump 20. The pump 20 is movable down within tubing 18 (e.g. coiled or production) which is an inner tubing and rests on part of a bottom hole assembly 15 which has a one way valve 16*a* which controls the flow of wellbore fluids to the pump 20. Coiled tubing or production tubing may be used; e.g., known small production tubing. The bottom hole assembly 15 is connected to the tubing 18 (but it can be, optionally, connected to the casing 24 which cases a wellbore 22).

The tubing 18 provides a fluid flow conduit for moving fluid to and from the pump 20. The tubing 18 and the casing 24 define a production fluid annulus 26 between them and the pump 20 pumps production wellbore fluids into the annulus 26 and to the surface. This production fluid annulus 26 can be used to: 1. conduct pumped fluid from the bottom of the annulus to the surface for removing fluid from the wellbore; and 2. conduct pumped fluid from the surface to the bottom hole assembly 15 for the purpose of moving (raising) the pump 20 to the surface within the bore of the coiled tubing 18.

Figure 2:
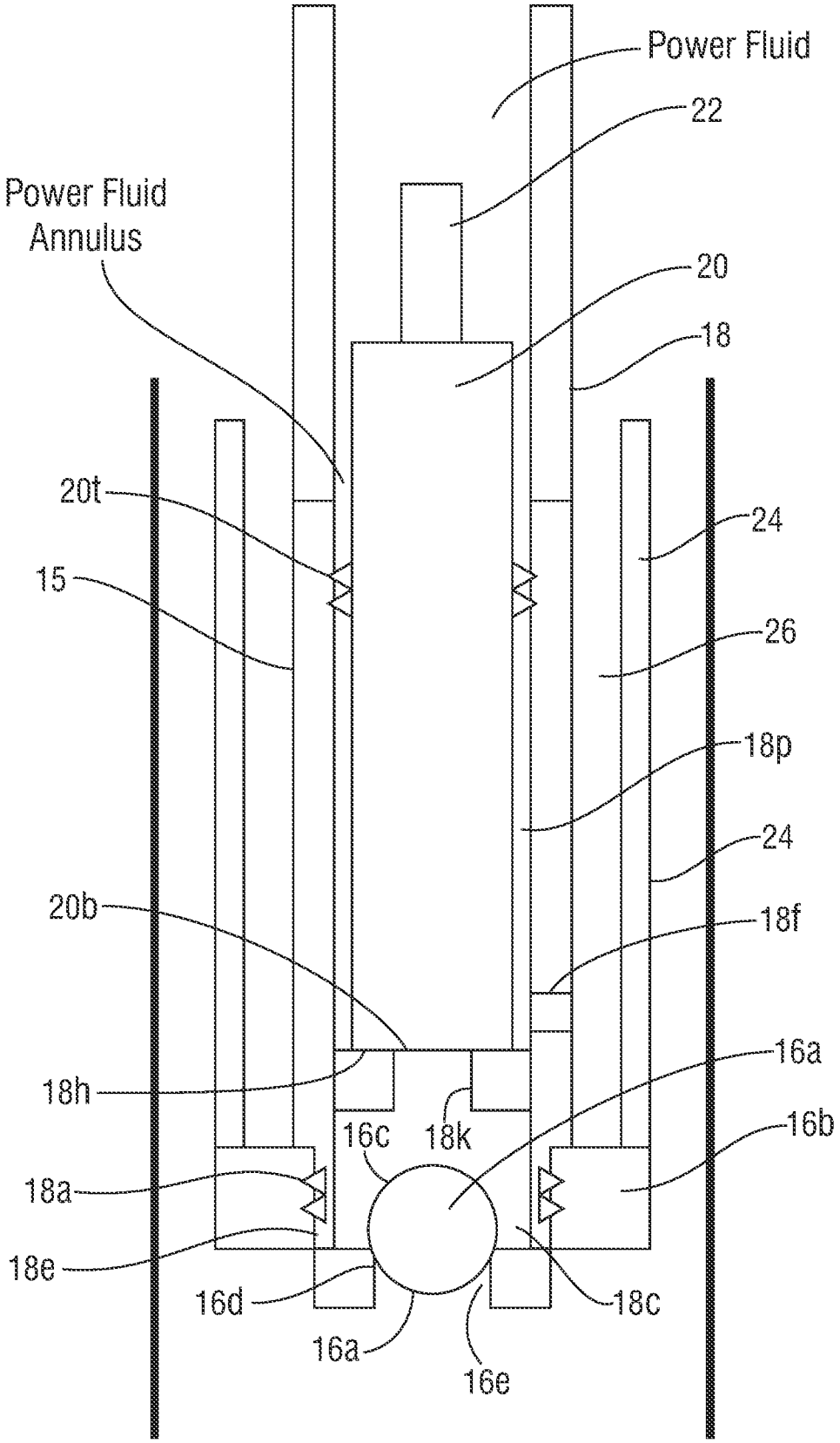
FIG. 2 is a crosssection view of part of the system of FIG. 1 showing the pump within the inner tubing and the inner tubing seated on the seating nipple of the bottom hole assembly.
Figure 2A:
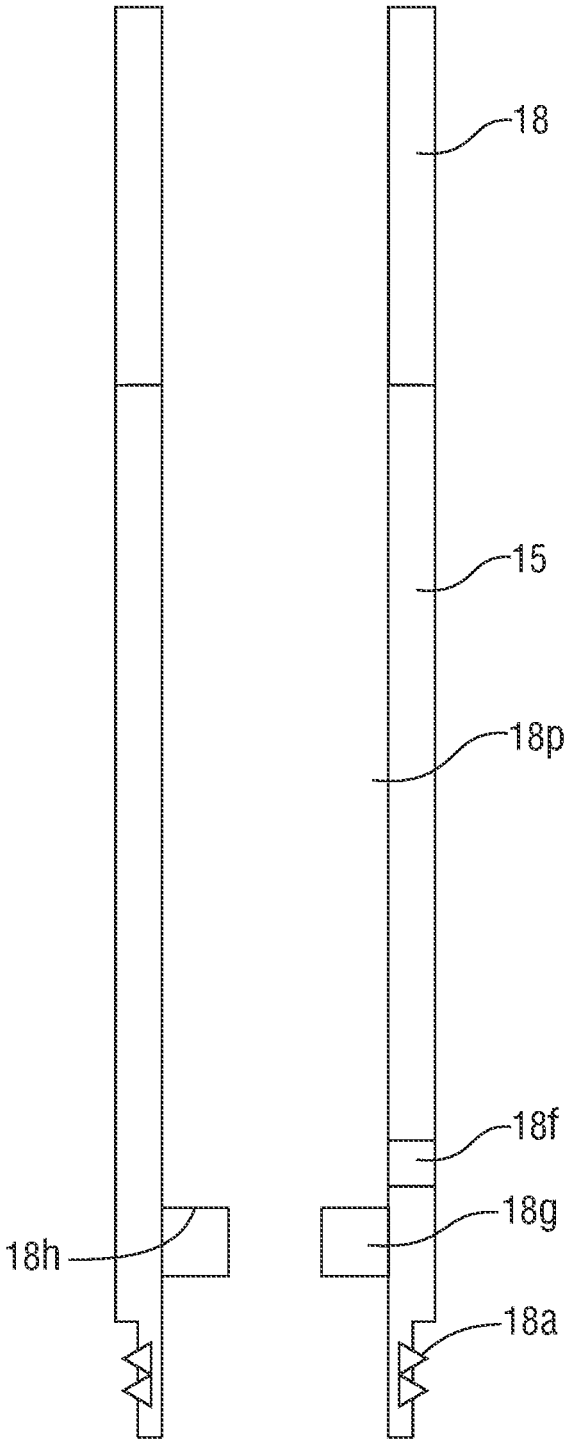
FIG. 2*a* shows the inner tubing of the system of FIG. 1 and as shown in FIG. 2.
Figure 2B:
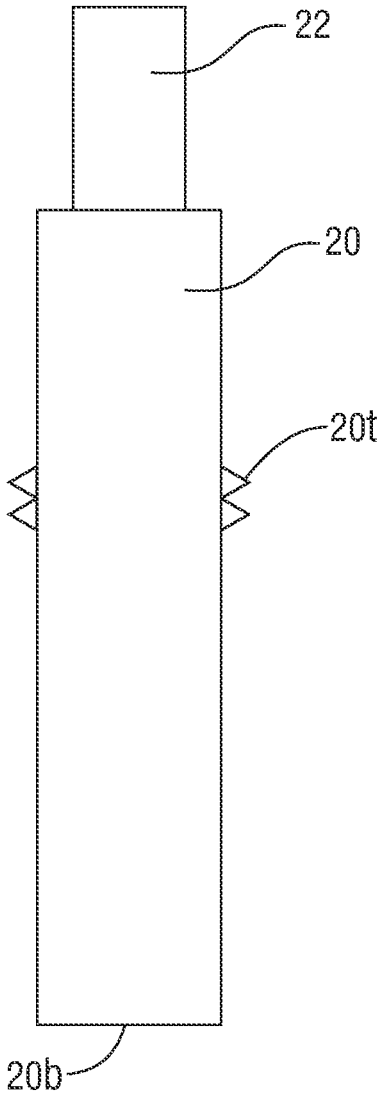
FIG. 2*b* shows the pump of the system of FIG. 1 and as shown in FIG. 2.

As shown in FIG. 1 and in more detail in FIGS. 2-2*b*, the bottom hole assembly 15 sits on a seating nipple 16*b* of the bottom hole assembly 15 so that the tubing/bottom-hole assembly interface is sealed with seals 18*a* on a nose 18*e* of the tubing 18. The one-way valve 16*a* includes a movable ball 16*c* and a valve seat 16*d* against which the ball 16*c* is held when the pump 20 is pumping fluid through a port 18*f* of the tubing 18 into the production fluid annulus 26. When the pump 20 is pumping production fluid through an opening 16*e* of the bottom hole assembly 16 into a space 18*c* within the tubing 18, the ball 16*c* is moved away from the valve seat 16*d* so that flow is possible through the opening 16*e*.

A bottom 20*b* of the pump 20 seals against a surface 18*h* of a shoulder 18*g* of the bottom hole assembly 15. Seals 20*t* seal a tubing/pump interface. Optionally, the pump 20 includes a control valve, in one aspect this is an integral control valve 22. The pump 20 may have a piston in the chamber 20*m* connected to the rod 20*e* or the rod 20*e* itself may act as a fluid displacer.

Figure 3:
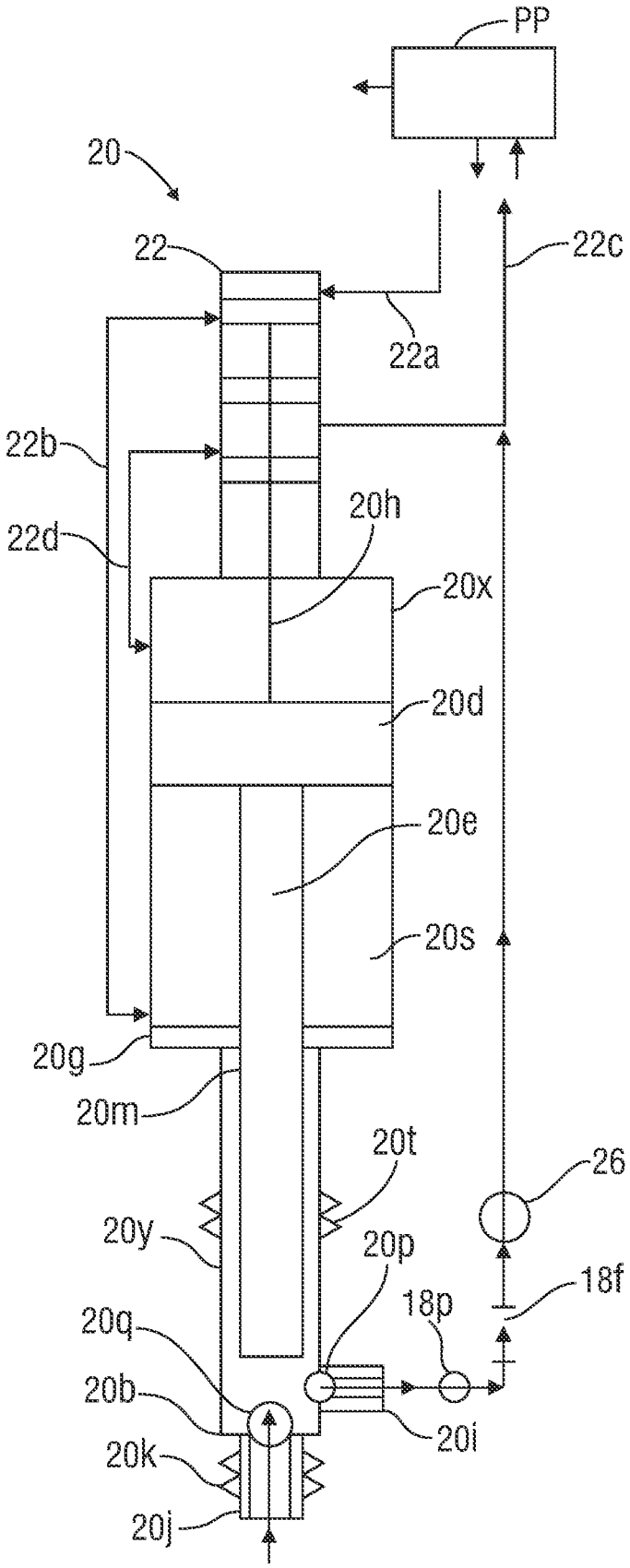
FIG. 3 shows an embodiment of a pump for a system according to the present invention.

The pump 20, in one embodiment as shown in FIG. 3, has a power section 20*x* and a production section 20*y*. The power section receives power fluid from the integral control valve 22 during a production fluid pumping operation. A power piston 20*d* connected to a power rod 20*e* moves within a chamber 20*s*, and part of the power rod 20*e* is movable in a chamber 20*m*. Downward movement of the rod 20*e* expels production fluid from the chamber 20*m* out through a valve 20*p* and a fluid outlet 20*i* into an annulus 18*p* between the pump and the interior surface of the tubing 18 (from this annulus 18*p* the fluid is pumped to a communication port 18*f*). Upward movement of the power piston 20*d* and the rod 20*e* draws production fluid from the wellbore through a valve 20*q*, through the opening 16*e* of the bottom hole assembly, through a fluid inlet 20*j* of the pump 20 and into the chamber 20*m*. A seal barrier 20*g* seals against the rod 20*e*. The fluid inlet 20*j* (see FIG. 3) extends into an opening 18*k* of the bottom hole assembly 15 and seals 20*k* seal the fluid inlet 20*j* in place (not shown in FIG. 2). Power fluid above the piston 20*d* is conducted via lines 22*d*, and the valve 22, and the line 22*c* back to a surface pump system PP. The valve 20*q* closes so that wellbore fluids are pumped out of the outlet 20*i*; and this valve opens to permit wellbore fluid to flow into the chamber 20*m*. The check valve 20*p* prevents wellbore fluids from flowing back into the chamber 20*m* through the outlet 20*i*. Fluid is forced into the production fluid annulus 26 only during system downstroke.

The seals 20*t* (see FIGS. 2, 2*b*, and 3) separate the higher pressure power fluid from the lower pressure produced fluid during pumping operations; and also separate the higher pressure retrieval fluid from the lower pressure tubing fluid during pump retrieval operation. The differential pressure across the seals 20*t* maintains pump 20 in seated production position during operation; and also the differential pressure across these seals lifts the pump 20 to surface during a retrieval operation.

In one embodiment, return fluid from the power section is mingled with production fluid during the pumping operation. The power piston moves downward, expelling fluid from beneath the power piston which is referred to as "return fluid". It is forced out of the power section, through the valve and into the produced fluid annulus. In one design, a one-way valve controls flow of this return fluid.

The integral valve 22 controls power fluid that moves the power piston/rod apparatus within the pump 20 and automatically reciprocates this power apparatus. The valve 22 directs power fluid from a line 22*a* to a line 22*b* to move the power apparatus upward, pumping production fluid into the chamber 20*m*. The valve then directs power fluid from the chamber 20*s* into a line 22*d* to move the power apparatus downward, pumping the production fluid from the chamber

20*m*, through the outlet 20*i*, into the production fluid annulus 26. The power fluid is pumped by the pump system PP on the surface.

A stroke indicator 20*h* is a slim diameter rod attached to the power piston which causes the valve to shift when the piston reaches the end of its stroke for each direction.

Figure 4:
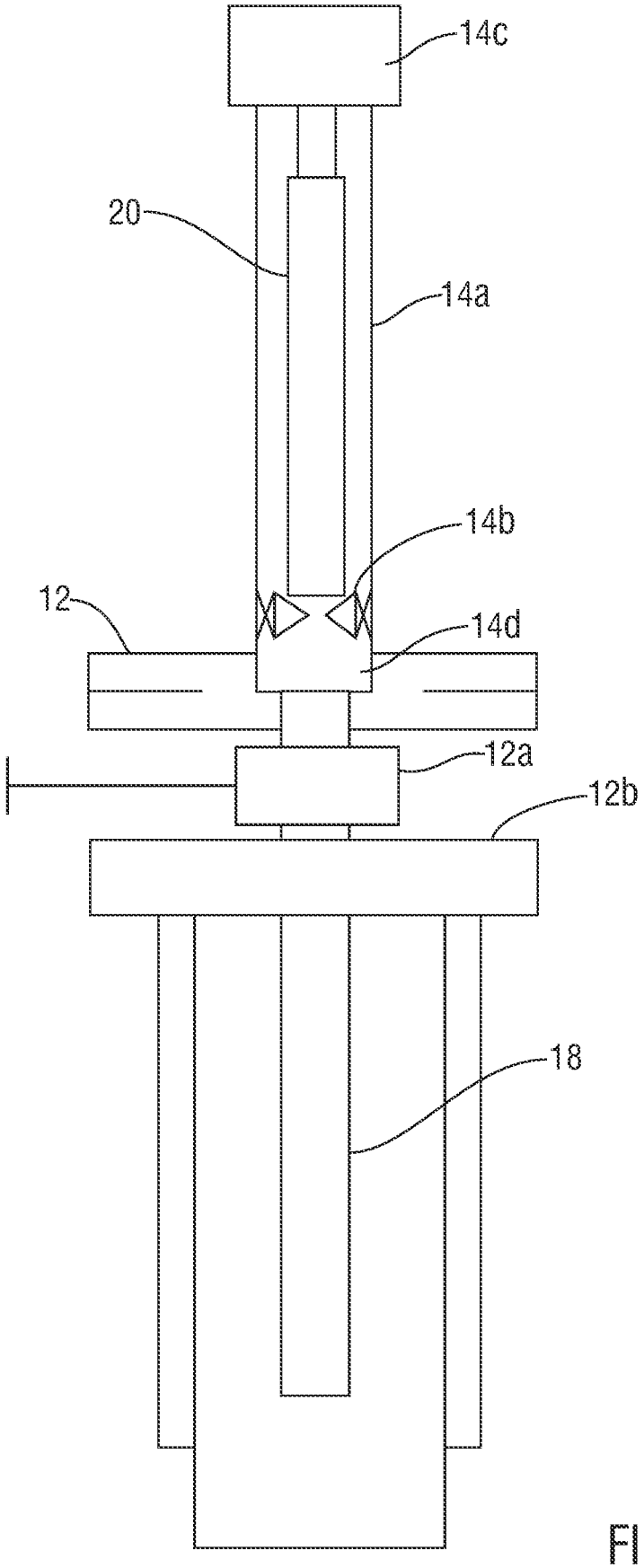
FIG. 4 shows a receiver for mounted on a wellhead for receiving a retrievable pump according to this invention.

FIG. 4 shows the pump receiver 14 on top of the wellhead 12. The wellhead 12 includes a shut off valve 12*a* and flange(s) 12*b* for mounting the wellhead at a wellbore. The receiver 14 has a housing 14*a* (also referred to as a "lubricator/catcher") sized and configured to receive and enclose the pump 20 after the pump 20 has been pumped into the housing 14*a*. A selectively actuatable latch 14*b* can maintain the pump 20 within the housing 14*a*. A removable cover 14*c* covers and closes off the housing 14*a*. With the cover 14*c* removed, the pump 20 can be removed from the housing 14*a*.

Figure 5:
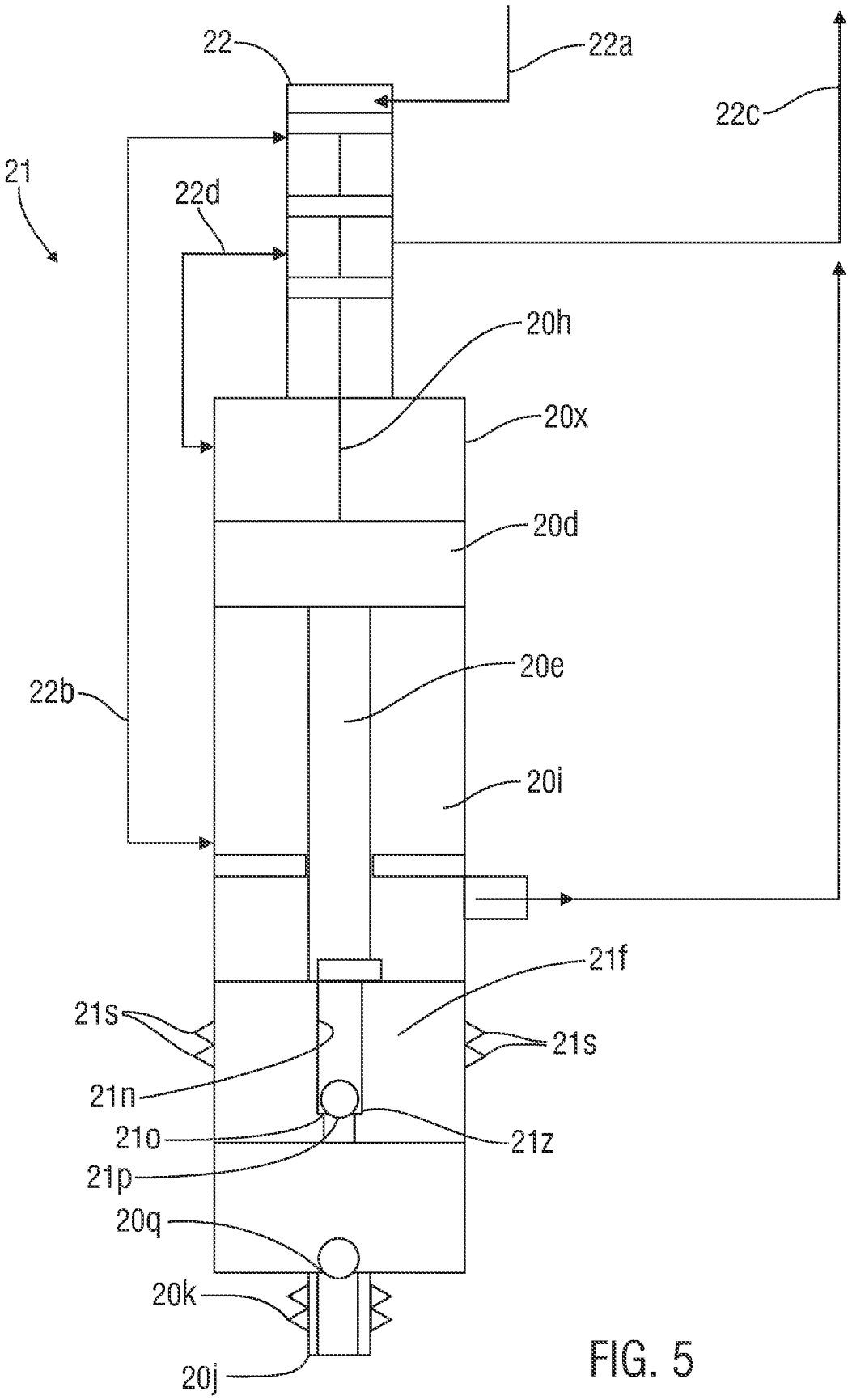
FIG. 5 shows an embodiment of a pump for a system according to the present invention.

The wellhead 12 may be any suitable known wellhead assembly with suitable known wellhead valves. Among other things, the wellhead 12 includes structures and apparatuses for: catching the pump 20 during a pump retrieval operation; for deploying the pump 20 during pump installation and replacement operations; and for isolating the pump 20 and the housing 14*a* from the wellbore during pump retrieval and deployment operations. FIG. 5 shows a pump system 21 somewhat like the system shown in FIG. 3. A fluid plunger 21*f* in a power section has an internal valve apparatus 21*z* that is a "travelling valve" which includes an inner channel 21*n* with a valve seat 21*o* against which can seat a ball 21*p* to selectively close off the valve apparatus 21*z* so that fluid flow through the channel 21*n* is prevented; e.g., when the fluid plunger is being raised. When the plunger 21*f* is moving downwardly, the ball 21*p* is unseated from the seat 21*o* allowing fluid to flow through the channel 21*n*. Other parts of the system 21 are like parts of the valve 20 and the same numerals as in FIG. 3 indicate like parts. Power section seals 21*s* are on the exterior of the power section.

With the system 21, production fluids enter the chamber 20*m* through the valve 21*z* on the system's upstroke and simultaneously fluid is forced out of the chamber through the outlet 20*i* to the surface. The valve 22 reverses the stroke and, as the rod 20*e* moves down, fluid in the chamber 20*m* is forced through the travelling valve 21*z* and above the plunger 21*f* and then out the outlet 20*i*. In a down stroke, the net volume of fluid expelled from the chamber 20*m* is the area of the rod times the stroke length.

Figure 6A:
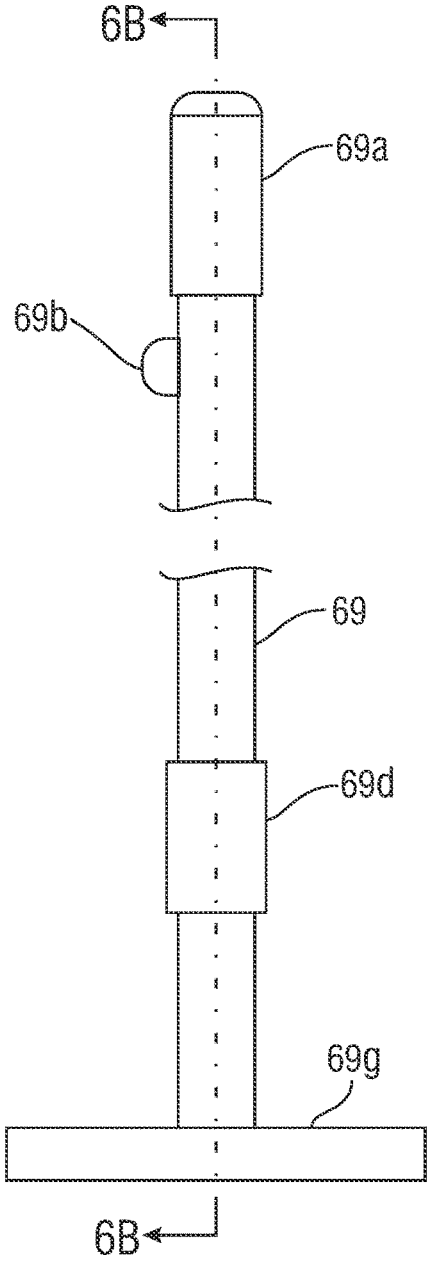
FIG. 6A is a front view of a pump system according to the present invention.
Figure 6B:
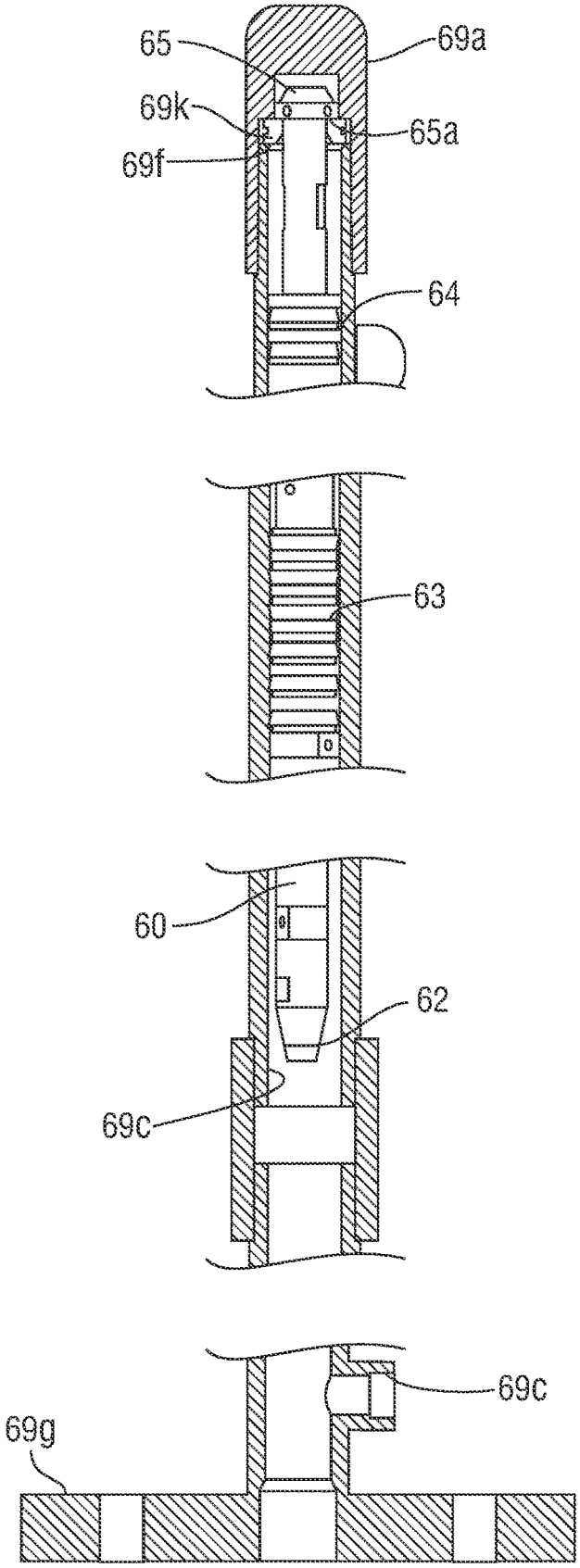
FIG. 6B is a crosssection view along line 6B-6B of FIG. 6A.

FIGS. 6A and 6B show a pump 60 according to the present invention releasably disposed within a bore 69*c* of a receiver 69. A flange 69*g* of the receiver 69 provides for connection of the receiver 69 to a wellhead (not shown; like the wellheads shown in FIGS. 1 and 4). The receiver 69 has a port 69*b* for a fluid conduit used during retrieval and deployment of pump so that the pump moves to the very top of the receiver; and a drain port 69*c* for draining the receiver prior to removing the pump from the receiver, e.g. draining power fluid from the receiver. A connector 69*d* provides a connection for connecting the receiver to the wellhead. A cap 69*a* provides access to the bore 69*c* for removal of the pump 60 and for access to a catch mechanism 69*f* which includes a movable catch member 69*k* movable to abut a shoulder 65*a* of an upper end 65 of the pump 60 to releasably hold the pump 60 within the receiver 69. In one aspect, the movable catch member is a release mechanism with a spring-loaded segmented collet. When the top of the pump encounters the collet, the collet expands over the top of the pump and then holds it.

The pump 60 has a sealing nose 62 for sealingly engaging another surface such as a surface of an opening of a bottom hole assembly (as in FIGS. 1, 2, and 2A). Seals 63 on a body 61 of the pump 60 are below and spaced apart from seals 64 on the body 61. In certain particular aspects, to assist in fluid circulation as the pump is moving into or out of a well, these seals are spaced apart a distance greater than the diameter or the largest dimension of any opening that the pump 60 will pass through when moving in tubing, thus inhibiting stalling of the pump when it passes through such an opening; i.e., no matter where the pump is, at least one set of seals will seal the pump/tubing-interior interface. Fluid passing around a first set of seals will be impeded by the second set of seals which is sufficiently spaced apart from the first set of seals.

The present invention therefore provides a method for pumping fluid from a wellbore, the method including pumping fluid from a wellbore, the fluid comprising a production fluid or combination of production fluids, the pumping effected with a wellbore fluid pumping system as any disclosed herein according to the present invention The present invention, therefore, provides a wellbore pumping system for pumping fluid, the system including inner tubing, for example coiled tubing or production tubing, a pump within the inner tubing, the pump comprising a retrievable reciprocating pump according to the present invention selectively disposable in the inner tubing. Such a system can have a second tubular such as production tubing or casing which encompasses the inner tubing, a bottom hole assembly connected to the second tubular, a landing structure for the bottom hole assembly, the pump movable to and from the landing structure of the bottom hole assembly. In one such system production fluids from a wellbore are pumpable by the pump into a production fluid annulus defined between the inner tubing and the second tubular for fluid flowing to and from the surface. In one such system the fluid is pumpable from the surface down the production fluid annulus to free the pump so that a freed pump is pumpable to the surface within the inner tubing. In such systems the pump may be deployed from and received back within a receiver on a wellhead at the surface. Such systems may include a power section and a power piston (or rod or fluid displacer) movable therein, and the integral valve controls the pump, and power piston reciprocable within the power section of the pump to provide reciprocal pumping action. Such systems can include a seating nipple at the bottom of the second tubular, e.g., production tubing or casing, and the bottom hole assembly is selectively disposable with the seating nipple. In such systems a bottom hole assembly has one port or a plurality of fluid communication ports which provide for the flow of production fluid pumped by the pump to flow into the production fluid annulus. Using such systems in a pumping operation, the power section can receive power fluid from the inner tubing; and return fluid from the power section can combine with pumped production fluid. In such systems the pump can be retrievable by reversing differential pressure across the pump; e.g., by directing power fluid down the produced fluid annulus and thereby lifting the pump to the surface. In such systems the pump can be pumped up the well and received within a receiver apparatus on top of the wellhead; e.g., a receiver apparatus in communication with the wellhead and having an isolation valve that is closeable once the pump is situated within the receiver apparatus. In such systems the pump can have a power section and a production section; the power section for receiving power fluid, e.g., but not limited to power fluid from an integral control valve during a production fluid pumping operation; a power piston connected to a power rod for movement within a first chamber and a produced fluid plunger (or rod or fluid displacer) connected to the power rod for movement in a second chamber; downward movement of the produced fluid plunger expelling production fluid from the second chamber out through a fluid outlet into an inner annulus between the pump and the interior surface of the inner tubing so that from this inner annulus fluid is pumpable to a communication port. In such systems upward movement of a power piston of the power section can draw production fluid from the wellbore, through an opening of a bottom hole assembly, through a fluid inlet of the pump and into the second chamber. In such systems there may be a seal barrier dividing the first chamber from the second chamber. Any pump in any system herein may have pump seals for separating higher pressure power fluid from lower pressure produced fluid during pumping operations; and/or also for separating higher pressure pump retrieval fluid from the lower pressure tubing fluid during a pump retrieval operation; and/or a differential pressure across the pump seals for maintaining the pump in a seated production position during operation; and/or differential pressure across these seals for lifting the pump to surface during a retrieval operation. In such systems it is possible to provide the mingling of return fluid from a power section with production fluid during a pumping operation when a power piston, rod, or fluid displacer moves downward, expelling fluid from beneath the power piston, which fluid is return fluid, which is forced out of the power section, through a valve and into a produced fluid annulus; with e.g., power fluid pumped by a pump on the surface.

The present invention provides, in certain aspects, a method for pumping fluid from a wellbore, the fluid comprising production fluid, the wellbore extending from an earth surface down into the earth, the method including: installing a pumping system with a pump according to the present invention and with the pump, pumping production fluid from the wellbore, up the annulus, and out of the wellbore.

The present invention provides, in certain aspects, a method for pumping fluid from a wellbore, the fluid comprising production fluid, the wellbore extending from an earth surface down into the earth, the method including: installing an outer tubular (e.g. casing or large tubing) in a wellbore; installing an inner tubing (e.g. production tubing or coiled tubing) within the outer tubular, an inner wall of the outer tubular and an outer wall of the inner tubing defining an annulus through which fluid is flowable; installing a system in the inner tubing, the system comprising a pumping system for pumping production fluid up the annulus and out of the wellbore, the pumping system including a pump, the pump comprising a retrievable reciprocating pump selectively disposable in the inner tubing, the pump having a power section for receiving power fluid and a power piston movable within the power section, the power piston reciprocable within the power section to provide reciprocal pumping action for pumping the production fluid, movement of the power piston drawing production fluid from the wellbore; and with the pump, pumping production fluid from the wellbore, up the annulus, and out of the wellbore.

Certain changes can be made in the subject matter disclosed without departing from the spirit of this invention. The following claims are intended to cover the invention as broadly as legally possible in whatever form. The invention claimed herein is new and novel in accordance with 35 U.S.C. § 102 and satisfies the conditions for patentability in § 102; and is not obvious in accordance with 35 U.S.C. § 103 and satisfies the conditions for patentability in § 103. All patents and applications identified herein are incorporated fully herein.

The invention claimed is:

1. A system for pumping production fluid from a wellbore, the wellbore extending from an earth surface down into the earth, the system installable in an inner tubing surrounded by an outer tubular in a wellbore, the outer tubular comprising production tubing or casing, an inner wall of the outer tubular and an outer wall of the inner tubing defining an annulus through which fluid is flowable, the system for pumping production fluid up the annulus and out of the wellbore, the system comprising a pump, the pump comprising a retrievable reciprocating pump selectively disposable in the inner tubing, the pump having a fluid inlet and a power section for receiving power fluid and a power piston movable within the power section, the power piston reciprocable within the power section to provide reciprocal pumping action for pumping the production fluid from the wellbore through the fluid inlet, movement of the power piston drawing production fluid from the wellbore, and a valve connected to the pump, the valve comprising an integral control valve for controlling the pump, the integral control valve able to provide power fluid to the pump to move the power piston to effect reciprocal pumping action, the power section able to receive power fluid from the inner tubing, and the pump having a production section, a first chamber, and a second chamber, the second chamber having a fluid outlet, and a power rod connected to the power piston, a plunger comprising a production fluid plunger connected to the power rod, the power rod for movement within the first chamber and the plunger movable within the second chamber so that downward movement of the plunger in the second chamber expels production fluid from the second chamber out through the fluid outlet into the annulus for pumping to the earth surface.

2. The system of claim 1 further comprising a pump seal structure on an exterior of the pump to seal between the exterior of the pump and an interior of the inner tubing, said pump seal structure comprising a plurality of seals including a first seal structure and a second seal structure, the first seal structure spaced apart from the second seal structure on the exterior of the pump, the first seal structure being sufficiently spaced apart from the second seal structure to insure effective sealing when the first seal structure is adjacent to an opening in the inner tubing while the second seal is not adjacent to said opening.

3. A method for pumping fluid from a wellbore and employing a pumping system as claimed in claim 2, the method comprising:

inhibiting pump stalling as the pump passes the opening in the inner tubing.

4. A method for pumping fluid from a wellbore and employing a pumping system as claimed in claim 1, the fluid comprising production fluid, the wellbore extending from an earth surface down into the earth, the method comprising:

installing the outer tubular in a wellbore, installing the inner tubing within the outer tubular, installing the pumping system in the inner tubing, and with the pump, pumping production fluid from the wellbore, up the annulus, and out of the wellbore.

5. The method of claim 4 further including the integral control valve providing power fluid to the pump to effect reciprocal pumping action, thus moving the pump to and from a landing structure of a bottom hole assembly connected to the outer tubular.

6. The method of claim 5 further comprising moving the pump down the inner tubing to seat on the landing structure of the bottom hole assembly.

7. The method of claim 6 wherein the bottom hole assembly has an opening, further comprising moving the power piston upward within the pump drawing production fluid from the wellbore, through the opening of the bottom hole assembly, through the fluid inlet of the pump and into the second chamber.

8. The method of claim 4 wherein a receiver is located above the wellbore at a wellhead of the wellbore further comprising pumping the pump up the wellbore into the receiver.

9. The method of claim 8 wherein the wellhead includes an isolation valve, the method further comprising closing the isolation valve with the pump within the receiver so that the receiver is isolated from fluid communication with the wellbore.

10. The method of claim 8 further comprising moving the pump from the receiver into a position within the inner tubing.

11. The method of claim 4 further comprising moving the power rod in the first chamber and moving the plunger in the second chamber to expel production fluid from the second chamber into the annulus.

12. The method of claim 4 further comprising moving the power piston downward to expel return fluid from beneath the power piston and out of the power section into the annulus so that the return fluid combines with pumped production fluid in the annulus.

13. The method of claim 4 wherein the pump is releasably secured in the inner tubing, further comprising pumping fluid down the annulus to free the pump.

* * * * *